US005116296A

United States Patent [19]

Watkins et al.

[11] Patent Number: 5,116,296

[45] Date of Patent: May 26, 1992

[54] ISOMETRIC LEG MUSCLE ERGOMETER

[75] Inventors: K. Richard Watkins, San Diego; Dale M. Daniels, La Mesa, both of Calif.

[73] Assignee: MEDmetric Corporation, San Diego, Calif.

[21] Appl. No.: 692,142

[22] Filed: Apr. 26, 1991

[51] Int. Cl.[5] ..... A63B 21/02

[52] U.S. Cl. ..... 482/91; 482/131; 482/903; 482/900; 128/25 R; 128/25 B; 602/26

[58] Field of Search ..... 272/125, 126, 129, DIG. 6, 272/DIG. 5; 128/25 R, 25 B, 80 C, 782

[56] References Cited

U.S. PATENT DOCUMENTS

| | | | |
|---|---|---|---|
| 1,590,499 | 6/1926 | Cozad | 128/782 |
| 3,285,070 | 11/1966 | McDonough . | |
| 3,374,675 | 3/1968 | Keropian . | |
| 3,670,573 | 6/1972 | Kroemer . | |
| 4,203,591 | 5/1980 | Gibson . | |
| 4,294,015 | 10/1981 | Drouin et al. . | |
| 4,374,588 | 2/1983 | Ruggles . | |
| 4,436,099 | 3/1984 | Raftopoulos | 128/782 |
| 4,586,495 | 5/1986 | Petrofsky | 272/125 |
| 4,718,665 | 1/1988 | Airy et al. . | |
| 4,765,315 | 8/1988 | Krukowski . | |
| 4,801,138 | 1/1989 | Airy et al. | 128/80 C |
| 4,804,001 | 2/1989 | McLeod, Jr. | 272/782 |
| 4,834,057 | 5/1989 | McLeod, Jr. | 272/782 |
| 4,838,272 | 6/1989 | Lieber . | |
| 4,848,152 | 7/1989 | Pratt, Jr. | 272/129 |
| 4,912,638 | 3/1990 | Pratt, Jr. | 272/129 |
| 5,013,037 | 7/1991 | Sterner | 272/80 X |
| 5,052,375 | 10/1991 | Stark et al. | 272/DIG. 6 |

OTHER PUBLICATIONS

"Electrical Neuromuscular Stimulation Protocol for Patellofemoral Problems", Medtronic, Inc., 1982.

Grood, Edward S. et al., "Biomechanics of the Knee--Extension Exercise", *The Journal of Bone and Joint Surgery, Incorporated*, Giannestras Biomechanics Laboratory, Department of Orthopaedic Surgery, University of Cincinnati Medical Center, Cincinnati, pp. 725-734.

"Introduction to Control Systems", All else unidentified.

Olsen, Suzanne et al., "Protocol for Total Knee Arthroplasty, Respond Quadriflex", Medtronic, Inc.

"Protocol for Range of Motion, Respond II Neuromuscular Stimulation System", Medtronic, Inc., 1982.

"Protocol: Stimulation for Patients with Knee Disorders, Respond II Dual-Channel Neuromuscular Stimulator", Medtronic, Inc., 1982.

*Primary Examiner*—Richard J. Apley
*Assistant Examiner*—Lynne A. Reichard
*Attorney, Agent, or Firm*—Nydegger & Associates

[57] ABSTRACT

The present invention is an ergometer for isometrically exercising one or more leg muscles of a patient undergoing rehabilitation of the knee joint following knee ligament surgery. The ergometer has an upper leg restraint and a lower leg restraint which are positioned on the leg above and below the knee respectively. The leg restrains are maintained in a fixed position relative to the leg by a rigid crossbar and a bolster positioned behind the knee. Exercise of the hamstring or quadriceps muscles is performed by isometrically contracting the desired muscles while the knee is at an extension angle which does not stress the ligament under repair. Muscle contraction can be artifically induced by an electrical stimulator, which in concert with a closed-loop control system, effectively regulates the exercise level.

23 Claims, 5 Drawing Sheets

ISOMETRIC LEG MUSCLE ERGOMETER

TECHNICAL FIELD

The invention relates to an exercise device which is useful for physical therapy. More particularly, the present invention pertains to a device for isometrically exercising a leg muscle.

BACKGROUND OF THE INVENTION

Knee ligament disruptions are common injuries resulting from accidents or traumatic shock sometimes experienced during sporting activities, such as skiing, football and soccer. Since the ligaments of the knee guide and constrain knee motion, their disruption can result in degenerative changes and subsequent injuries to the knee if the damage is not treated soon after the initial injury. Reconstructive surgery is commonly employed to restore the knee to its preinjured condition and function.

Leg strength and muscle mass, however, are invariably sacrificed during recovery from surgery, while motion and muscle tension are limited. This effect is especially pronounced in the quadriceps muscles. The amount of lost quadriceps mass is directly related to the length of time the muscles are immobilized or limited during such activities as walking, squatting, stair climbing and cycling. Thus, it is necessary to undertake an effective exercise regimen as early as possible to restore normal muscle mass.

It is known that muscles are strengthened and their mass increased by repetitive contraction of the muscles under tension. When the muscle contracts, however, it shortens, thereby causing joint motion via the connective tendons which can stress the ligaments connecting the bony joint segments. When the damaged knee is reconstructed, as when a cruciate ligament is replaced or reattached to its bony terminus, the repair must be protected from stress until biological mending is near completion. Thus, conventional modes of quadriceps and hamstring exercises are prohibited during this period of recovery.

It is further known that contraction of the quadriceps muscles causes anterior displacement of the tibia relative to the femur when the knee is in early flexion, i.e., from full extension, which is defined as 0°, up to an extension angle of about 70°. Anterior displacement of the tibia is even more pronounced when the anterior cruciate ligament is torn. Thus, it is apparent that contraction of the quadriceps muscles during early knee flexion stresses or loads the anterior cruciate ligament. Studies also indicate that the anterior cruciate ligament is not stressed by contraction of the quadriceps muscles during late knee flexion, i.e., 70° to 90°. Contraction of the quadriceps muscles, however, causes posterior displacement of the tibia when the knee is in late flexion. Thus, the posterior cruciate ligament is apparently stressed by contraction of the quadriceps muscles during late flexion, but not during early flexion. Hamstring muscle contraction is also thought to cause tibial displacement and corresponding stressing of the cruciate ligaments when the knee is at different angles of extension.

Recognition of these ranges of extension angles suggests an exercise modality which spares the surgically reconstructed cruciate ligament from loading or stress during contraction of the hamstring or quadriceps muscles. As such a leg muscle exercise device is needed which effectively operates within these safe exercise modes. More particularly, a leg muscle exercise device is needed which provides for safe early exercises to minimize lost muscle mass and strength during surgical rehabilitation. Further, a reliable means of measuring or controlling the force extended by the muscle without supervision is needed during voluntary or electrically simulated contractions of the muscles.

SUMMARY OF THE INVENTION

The present invention is an ergometer for isometrically exercising a particular leg muscle or muscle group. Preferably, the ergometer is used to isometrically exercise either one of two muscle groups, the quadriceps or the hamstring. The apparatus is particularly suited for use by patients undergoing rehabilitation of the knee joint following knee ligament surgery, and more particularly surgery to repair a cruciate ligament, either anterior (ACL) or posterior (PCL). The ergometer enables a patient to engage in leg muscle strengthening exercises without stressing the repaired cruciate ligament. Consequently, a patient can use the ergometer to avoid significant atrophy of the leg muscles even within a very short time after surgery.

The ergometer comprises an upper leg restraint and a lower leg restraint which are connected to one another by a rigid crossbar and are positioned to engage the upper and lower leg above and below the knee respectively. The ergometer further comprises a bolster which fits against the popliteal surface behind the knee and is suitably connected to both of the leg restraints.

The restraints are preferably straps which are connected to the crossbar and wrap around the upper and lower leg to tightly secure the crossbar thereto. Among the several embodiments of the present invention, the restraints may further be provided with upper and lower leg abutting members across which the straps can connect with the crossbar. The leg abutting members may be positioned so that the abutting members engage either the back of the leg or the front of the leg. The bolster can connect with the upper and lower leg restraints by engaging the crossbar or, alternatively, independent means can be provided to connect the bolster directly with the upper and lower leg restraints.

The crossbar comprises two rigid arms, a proximal and a distal arm, which extend from the upper and lower leg restraints respectively and which join at a torque member. One end of the proximal arm engages the upper leg restraint and one end of the distal arm engages the lower leg restraint. The torque member is integral with the remaining two ends of the proximal and distal arms which do not engage the leg restraints. The relative positions of the proximal and distal arms at the torque member may be substantially fixed to permanently define a predetermined fixed angle of leg extension, or alternatively, the positions of the arms may be varied from patient to patient to adjustably define a predetermined fixed angle of leg extension.

The patient operates the ergometer by positioning it on the leg and securing it thereto. Exercise of the hamstring or quadriceps muscle group is performed by contracting the desired muscle group while the leg is positioned at a predetermined fixed extension angle which does not substantially load the particular cruciate ligament in need of protection. Thus, for example, if quadriceps exercise is desired without stressing the ACL, the patient contracts the quadriceps muscles in an effort to straighten the immobilized leg in late flexion and the lower leg exerts an upward force against the lower leg restraint.

In either case, the force applied to the lower leg restraint is transmitted to the rigid crossbar which is prevented from moving because it is connected to the upper leg restraint which is in turn anchored to the stationary upper leg. Thus, the leg and ergometer remain essentially static relative to one another while the quadriceps or hamstring muscle group is being contracted, thereby isometrically exercising that particular muscle group.

In a further embodiment of the invention, the crossbar is provided with a force gauge for measuring the degree of force applied to the ergometer through the leg by the quadriceps. This force is a measure of strength of the muscle being exercised and can be used as an indicator of the patient's rehabilitative progress. The force gauge is preferably a plurality of strain gauges positioned on the torque member. When a force is transmitted to the crossbar from the leg restraint, a torsional force is applied to the torque member. The strain gauges measure the torsional force which is correlated to the force of the patient's leg against the leg restraint.

The ergometer can further be provided with an alarm which is in communication with the force gauge. The alarm is activated when the force measured at the force gauge exceeds a certain level. Typically the alarm is set to activate at a force level which corresponds fo the maximum safe level of exercise for the recuperating patient. The alarm provides the ergometer with a built-in safety feature which reduces the risk of injury from a self-administered exercise program.

The ergometer can also be provided with a recorder or display which is in communication with the force gauge to facilitate storage of or access to the force data for analysis.

In yet another embodiment of the invention, the ergometer can be provided with an electric muscle stimulator which can be placed in electrical communication with the muscle or muscles being exercised. Muscle contractions are then induced by activation of the stimulator. The level of exercise is controlled by regulating the degree of electric stimulation applied to the muscles.

Control of the stimulator can be performed manually in conjunction with the above-recited alarm or it can be performed automatically by means of a closed-loop control system incorporated with the ergometer. The closed-loop control system comprises a command output, a feedback loop, and a comparator.

In the operation of the closed-loop control system, an operator enters a series of parameters into the command output. These parameters include the level of force which the operator desires the leg to exert against the ergometer as well as data physically characterizing the patient. The command output processes these parameters and generates a command signal which it sends to the stimulator. The command signal instructs the stimulator to stimulate the desired muscles to a degree necessary to induce the desired level of force on the ergometer.

The ergometer translates the resulting muscle contraction to a torsional force which is transmitted as a feedback signal through the feedback loop to the comparator. The comparator compares the command signal to the feedback signal and, if there is a difference, generates an error signal. The error signal is consequently sent to the stimulator, adjusting the stimulator output accordingly.

It is, therefore, apparent that when the force gauge measures an excessive force on the ergometer, a comparison of the feedback and command signals will indicate an excessive degree of stimulation to the muscles. The comparator will accordingly generate an error signal dictating a lower degree of stimulation. Conversely, when the force gauge measures an insufficient force, the comparator will generate an error signal dictating a higher degree of stimulation. Thus, the closed-loop control system enables the patient to engage in a closely controlled exercise program without direct supervision.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF PREFERRED EMBODIMENTS

Figure 1:
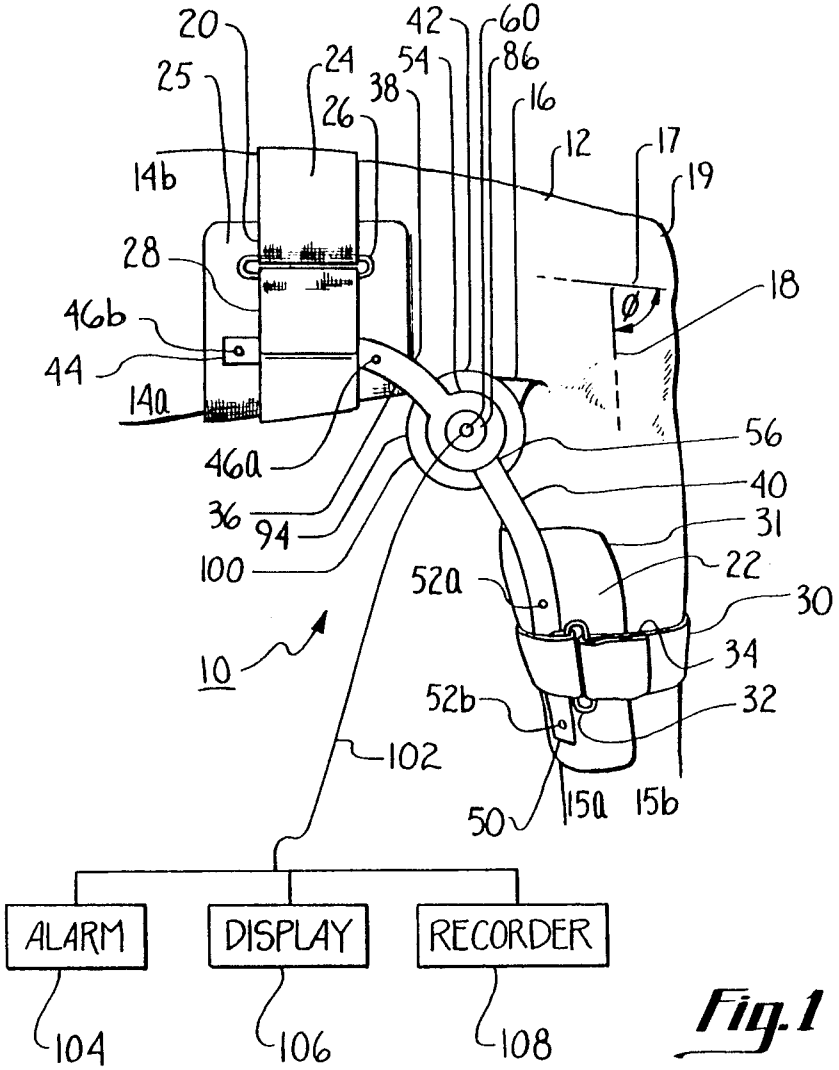
FIG. 1 is a side view of a first embodiment of the ergometer of the present invention with the ergometer positioned on the leg of a user.

Referring initially to FIG. 1, a first embodiment of the ergometer of the present invention is shown and generally designated as 10. Ergometer 10 is shown in position on the right leg 12 of a patient undergoing rehabilitation after reconstructive knee surgery.

Ergometer 10 engages the upper leg 14, the lower leg 15, and the popliteal surface 16 to maintain the knee 19 at a predetermined fixed extension angle designated as $\phi$ and defined by the intersection of a line 17 drawn substantially through the femur and a line 18 drawn substantially through the tibia. The upper leg 14 is defined as the portion of the leg 12 above the knee 19 and the lower leg 15 is defined as the portion of the leg 12 below the knee 19. The popliteal surface 16 is defined as the exterior surface of the popliteal space which is the portion of the leg 12 behind the knee 18.

Figure 3:
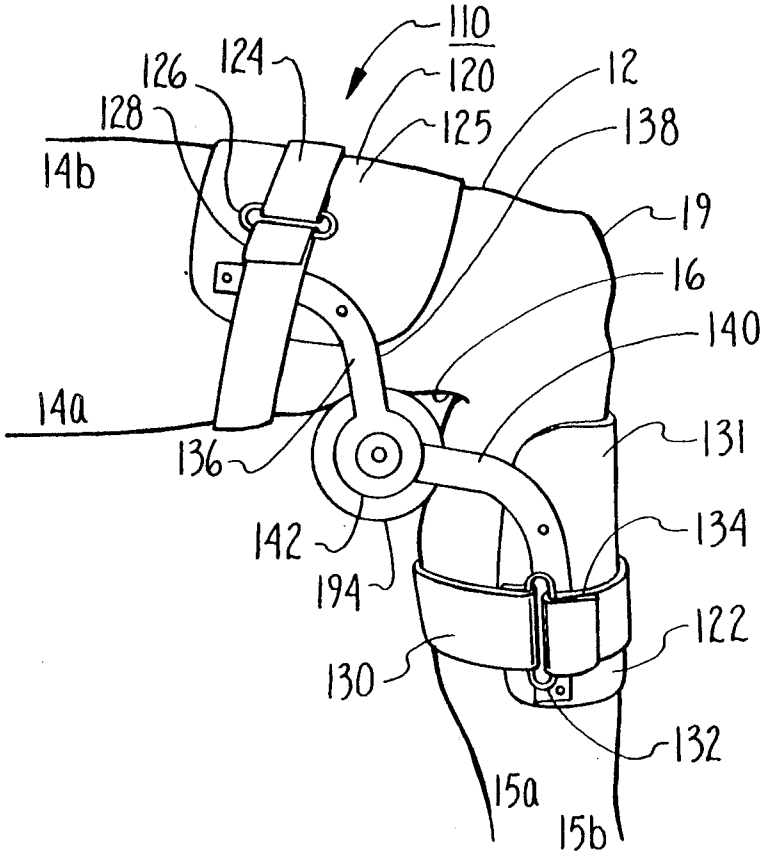
FIG. 3 is a side view of a second embodiment of the ergometer of the present invention with the ergometer positioned on the leg of a user.
Figure 5:
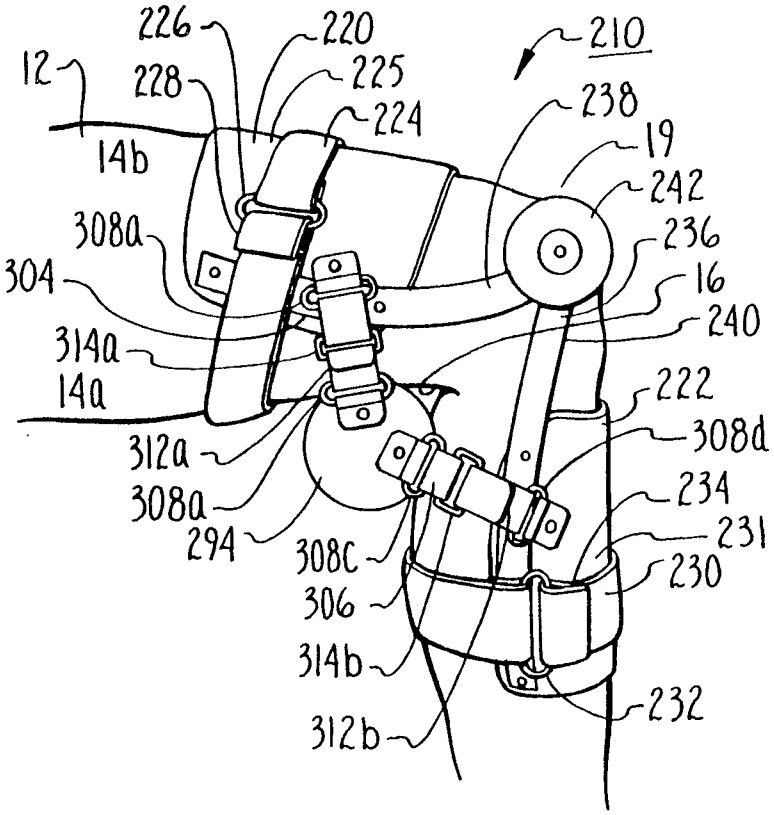
FIG. 5 is a side view of a third embodiment of the ergometer of the present invention with the ergometer positioned on the leg of a user.

The extension angle $\phi$ is shown in FIGS. 1, 3, and 5 as approaching 90° to minimize the load on the ACL during exercise of the quadriceps muscle group. It is understood that among other alternatives, the extension angle $\phi$ can be selected as approaching 0° to minimize the load on the PCL. Likewise, safe extension angles $\phi$ can be selected to minimize ACL or PCL loading during exercise of the hamstring muscle group.

Ergometer 10 comprises an upper leg restraint 20 and a lower leg restraint 22. Upper leg restraint 20 includes an upper leg strap 24 and a posterior upper leg abutting member 25. Lower leg restraint 22 correspondingly includes a lower leg strap 30 and a posterior lower leg abutting member 31. Upper leg strap 24 wraps around upper leg 14 and posterior upper leg abutting member 25 to secure ergometer 10 to upper leg 14.

In detail, strap 24 secures ergometer 10 to the upper leg 14 by attaching one end of strap 24 to upper leg abutting member 25 and threading the other end of strap 24 through a guide loop 26 affixed to upper leg abutting member 25. Strap 24 is then cinched around the upper leg 14 and held with a velcro fastener 28. In this position strap 24 firmly engages posterior upper leg abutting member 25 and the anterior upper leg **14*b*. Ergometer 10 is secured to the lower leg 15 in a like manner with lower leg strap 30, lower leg abutting member 31, guide loop 32, and velcro fastener 34**.

Straps 24 and 30 are preferably fabricated from a soft pliable material which is substantially resistant to stretching. Leg abutting members 25 and 31 may be rigid pads which substantially resist deformation when subjected to forces within the operating range of ergometer 10. Leg abutting members 25 and 31 may further be formed to fit against the contours of the posterior upper leg **14*a* and posterior lower leg 14*b*** respectively.

Upper and lower leg restraints 20 and 22 are fixably connected to one another by a rigid crossbar 36. Crossbar 36 is fabricated from a high strength, substantially inelastic material. Crossbar 36 comprises a proximal arm 38 and a distal arm 40 having ends 54 and 56 respectively which engage one another at an adjustable torque member 42.

The end of proximal arm 44 opposite torque member 42 is attached to upper leg abutting member 25. Attachment is provided by a plurality of rivets shown herein as **46*a*, 46*b*. Attachment of distal arm 40 to lower leg abutting member 35 is likewise fixably provided by rivets 52*a*, 52*b*. Although not shown, it is apparent that arm 38 and abutting member 25 can be fabricated from the same material as a single integral unit so that connecting rivets 46*a*. 46*b* are not required. The same applies to arm 40 and abutting member 31**.

Adjustable torque member 42 is described in detail below with reference to FIG. 7. Torque member 42 is preferably integral with the ends of proximal and distal arms 54 and 56 respectively. Both ends 54, 56 are formed in the shape of discs. End 54 is provided with a circular central opening 58, while end 56 is provided with a central post 60 extending orthogonally therefrom. Central post 60 has three stages 62, 64, 66, successively diminishing in cross-sectional area.

Stage 62 is the broadest stage and is circular. Stage 62 has substantially the same diameter as opening 58, only slightly smaller to enable stage 62 to receive opening 58. Further, the depth of opening 58 is substantially the same as the height of stage 62 so that end 54 is substantially flush with the top of stage 62 when fitted thereon.

Stage 64 is square-shaped to receive the square opening 74 of washer 72 in close fitting relationship thereto. A force gauge is positioned on the face 65 of stage 64 to engage the surface of square opening 74 and to measure the torsional forces on torque member 42. As shown here, force gauge is a plurality of strain gauges **75*a*, 75*b*, wherein each of the four faces 65 of stage 64 has a strain gauge 75** positioned thereon.

FIG. 1 schematically depicts a series of functional units interactive with strain gauges 75. The units include an alarm 104, a display 106 and a recorder 108 which are all in electrical communication with strain gauge 75 via line 102. The units 104, 106, 108 are described hereafter in more detail with respect to the present method of operation.

Referring again to FIG. 7, the depth of opening 74 is substantially the same as the height of stage 64 so that washer 72 is substantially flush with the top of stage 64 when fitted thereon. A spring 76 is provided between stage 62 and washer 72 to bias washer 72 in an upward direction when fitted on stage 64. Teeth 78 are provided on the top surface 80 of end 54 to circumscribe opening 58. Corresponding teeth 82 are provided on washer bottom 84 to grip teeth 78 when washer 72 abuts end 54.

To maintain end 54 and washer 72 fixed on stages 62 and 64 respectively, a circular nut 86 having an internally threaded central opening 88 is threaded onto the externally threaded cylindrical stage 66. Thus, teeth 78, 82, spring 76, and nut 86 act in concert to secure torque member 42 from rotation when torsional forces are applied to it across arms 38, 40. It is further apparent that loosening of nut 86 enables rotatable adjustment of the relative positions of arms 38, 40 when desired. However, nut 86 is always returned to a tightened position when muscle exercise is being performed with ergometer 10.

Referring back to FIG. 1, ergometer 10 is further provided with a bolster 94 positioned at the popliteal surface 16. Bolster 94 rests against the popliteal surface 16 and acts as a fixed support about which the leg 12 is maintained at fixed extension anqle $\phi$. Although not shown, it is to be understood in this first embodiment as well as each subsequent embodiment described hereafter, that a nonadjustable torque member may be substituted for adjustable torque member 42 shown in FIG. 7. The nonadjustable torque member substantially permanently joins arms 38, 40 at ends 44, 50 to define a substantially permanent fixed extension angle $\phi$ for exercising the leg muscles.

Figure 2:
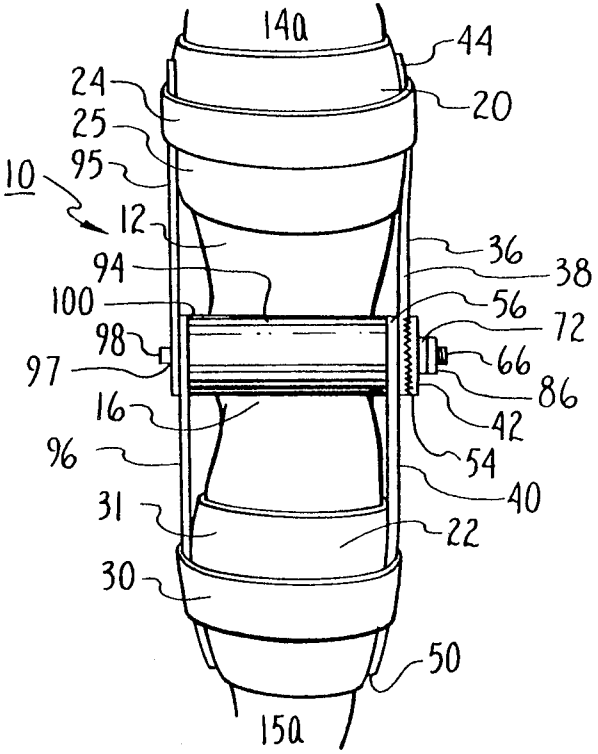
FIG. 2 is a rear view of the first embodiment of the ergometer positioned on the leg of a user.
Figure 7:
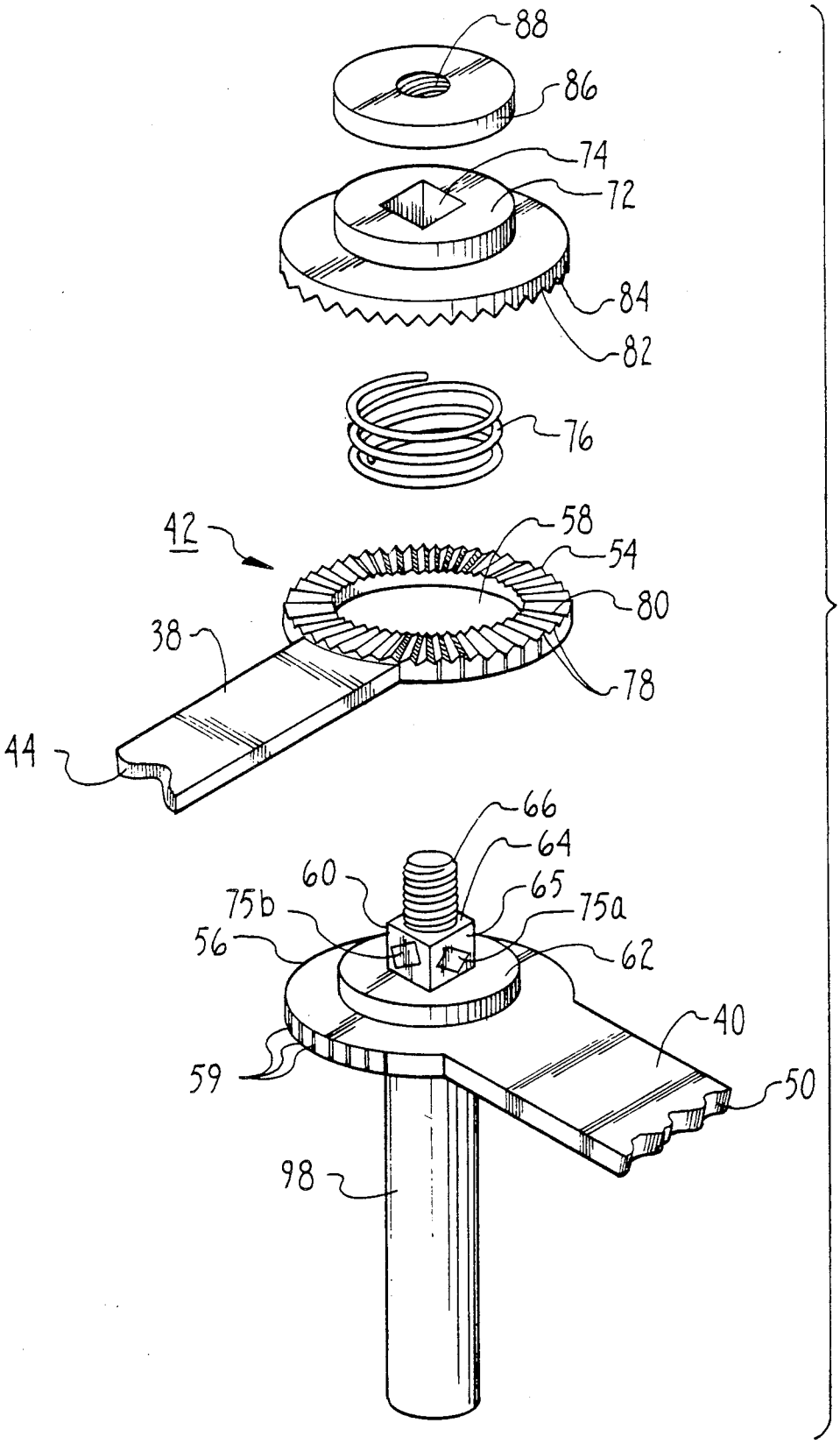
FIG. 7 is an exploded perspective view of the rigid crossbar including an adjustable torque member.

Referring to FIGS. 2 and 7, bolster 94 is shown to be integral with torque member 42. Bolster 94 comprises a cylindrical member 98 extending orthogonally from end 56 in the opposite direction as post 60. A rigid pad 100 is positioned around bar 98 to support the knee 19 at the popliteal surface 16 when exercising. Bolster 94 is sized to extend across the width of the popliteal surface 16. Upper and lower alignment arms 95, 96 engage bolster 94 opposite crossbar 36 to maintain the lateral alignment of the knee 19 on bolster 94. Arms 95, 96 are joined at one end by member 98 at a rotatable hinge 97 about which arms 95, 96 are freely rotatable. At their respective opposite ends, arms 95, 96 fixably engage abutting members 25 and 31 in a similar manner to arms 35 and 40.

FIG. 2 further shows the position of crossbar 36 on the lateral side of the leg 12 slightly away from the leg 12 so as not to interfere with positioning of leg restraints 20, 22 on the leg 12. Lateral placement of crossbar 36 also prevents the protruding torque member 42 from injuring the patient's opposite leg during use of ergometer 10.

A second embodiment of the present invention is shown in FIG. 3, an ergometer generally designated as 110 positioned on the right leg 12 of a patient. Ergometer 110 has a structure similar to that of ergometer 10, however, upper and lower leg restraints 120 and 122 of ergometer 110 include anteriorly positioned upper and lower leg abutting members 125 and 131 in contrast to the posteriorly positioned upper and lower leg abutting members 25 and 31 of ergometer 10. Consequently, upper and lower leg abutting members 125 and 131 are formed to fit against the contours of the anterior upper and lower legs 14*b*, 15*b* respectively.

Leg restraints 120 and 122 are provided with upper and lower leg straps 124, 130, guide loops 126, 132, and fasteners 128, 134, which function in an analogous manner to like elements 24, 30, 26, 32, 28, and 34 of ergometer 10. Ergometer 110 is further provided with crossbar 136, torque member 142, bolster 194 and alignment arms 95, 96 which are substantially similar in structure and function to those of ergometer 10. However, because proximal and distal arms 138 and 140 are attached to anterior leg abutting members 125, 131, the relative orientation of arms 138 and 140 is different than that of 38 and 40 to achieve the same extension angle $\phi$ of the leg 12.

Although not shown in FIG. 3, it is apparent that strain gauges can be provided on torque member 142 which is in electrical communication with some or all of units 104, 106, 108 in a like manner as torque member 42 shown in FIGS. 1 and 7.

Figure 4:
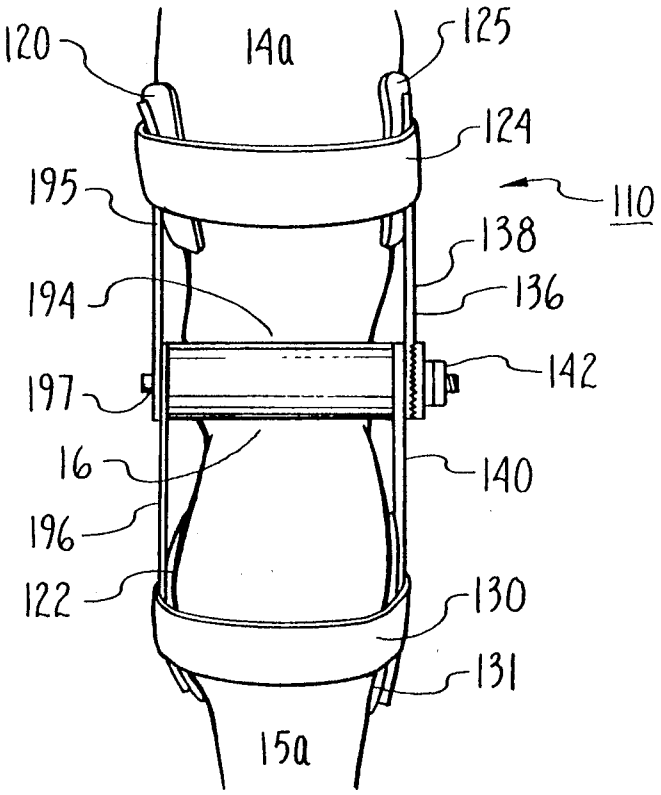
FIG. 4 is a rear view of the second embodiment of the ergometer positioned on the leg of a user.

FIG. 4 shows ergometer 110 from the backside as it is positioned on leg 12. Torque member 142 and bolster 194 are positioned in substantially the same orientation as torque member 42 and bolster 94 of ergometer 10. Straps 124, 130 engage the posterior upper and lower legs 14*a*, 15*a* to secure ergometer 110 thereto.

A third embodiment of the invention is shown in FIG. 5, an ergometer generally designated as 210 positioned on the right leg of a patient. Like ergometer 110 of FIG. 3, ergometer 210 is provided with upper and lower leg restraints 220, 222, having straps 224, 230, anterior upper leg abutting member 225, anterior lower leg abutting member 231, guide loops 226, 232, and fasteners 228, 234. Ergometer 210 is further provided with crossbar 236, torque member 242, bolster 294, and alignment arms 295, 296. However, whereas bolsters 94 and 194 of ergometers 10 and 110 are integral with torque members 42 and 142 respectively, bolster 294 of ergometer 210 is connected to leg restraints 220, 222 independent of torque member 242.

Ergometer 210 is provided with two pairs of bolster straps 300, 302, 304, 306, one pair 304, 306 on the lateral side of the right leg 12 and the other pair 300, 302 on the medial side, which connect bolster 294 to anterior upper and lower leg abutting members 225, 231. The bolster straps 300, 302, 304, 306 may be fabricated like straps 224, 230 from a soft pliable material such as woven nylon.

FIG. 5 shows upper and lower lateral straps 304, 306. Strap 304 is connected to anterior upper leg abutting member 225 through lateral bolster strap loop 308*a* and to bolster 294 through bolster strap loop 308*b*. Strap 306 is connected to anterior lower leg abutting member 231 through bolster strap loop 308*c* and to bolster 294 through bolster strap loop 308*d*.

Figure 6:
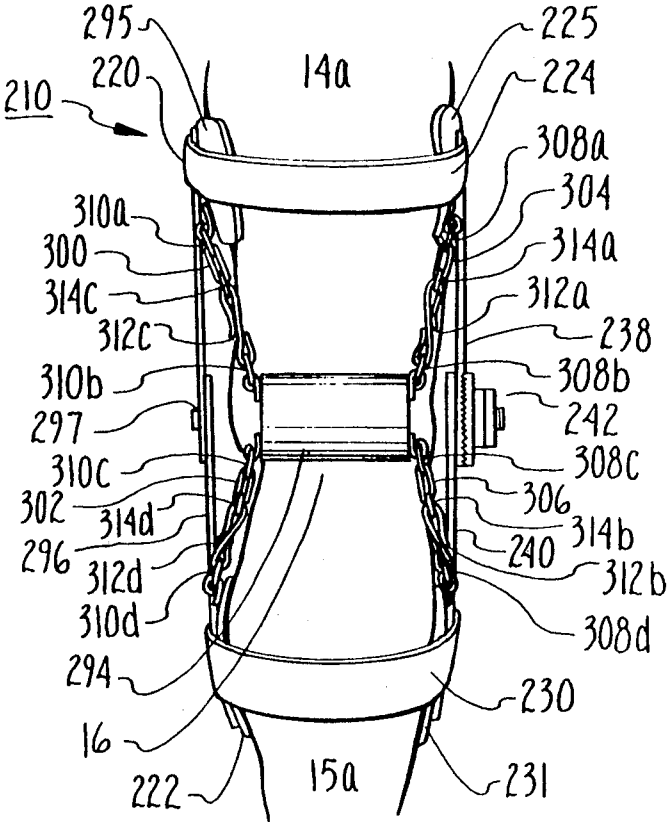
FIG. 6 is a rear view of the third embodiment of the ergometer positioned on the leg of a user.

Medial straps 300, 302 shown in FIG. 6 connect bolster 294 to leg abutting members 225, 231 on the medial side of leg 12 in a like manner through medial bolster strap loops 310*a*, 310*b*, 310*c*, 310*d*. Bolster straps 300, 302, 304, 306 tightly secure bolster 294 against the popliteal surface 16 by cinching and fastening each strap 300, 302, 304, 306 utilizing velcro fasteners 312*a*, 312*b*, 312*c*, 312*d* and cinch loops 314*a*, 314*b*, 314*c*, 314*d*.

Torque member 242 is substantially the same as torque member 42 shown in FIG. 7 except that torque member 242 is not provided with bolster bar 98 because torque member 242 is not integral with bolster 294. Consequently, crossbar 236 and torque member 242 may be positioned independent of bolster 294. Typically, torque member 242 is positioned immediately adjacent the knee 19. Therefore, the relative orientation of proximal and distal arms 238 and 240 is different than that of arms 138 and 140 to achieve the same extension angle $\phi$ of the leg 12. Although not shown in FIG. 5, it is apparent that a strain gauges can be provided on torque member 242 which is in electrical communication with some or all of units 104, 106, 108 in a like manner as torque member 42 shown in FIGS. 1 and 7.

Each embodiment of the present invention set forth above has shown a pair of upper and lower leg restraints 20, 22; leg abutting members 25, 31; 125, 131; 225, 231 respectively. 120, 122; 220, 222 which includes a pair of upper and lower leg abutting members 25, 31; 125, 131, 225, 231 respectively. However, it is to be understood, that leg restraints can be provided which do not include leg abutting members. In such a case, the leg restraint straps 24, 30; 124, 130; 224, 230 are connected to crossbar 36, 136, 236 respectively by affixing them directly to arms 38, 40; 138, 140; 238, 240.

Figure 8:
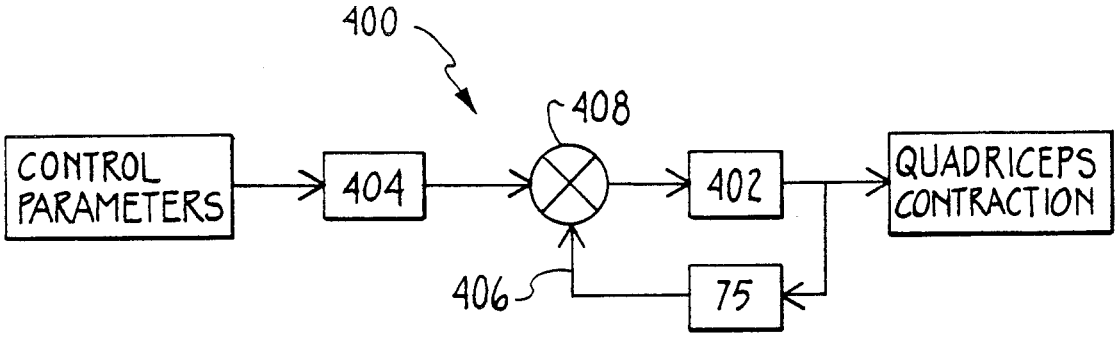
FIG. 8 is a schematic of the closed-loop control system incorporated with the ergometer of the present invention.

FIG. 8 schematically depicts a closed-loop control system generally designated as 400 which is incorporated with ergometer 10. The control system 400 comprises an electrical stimulator 402 which is in electrical communication with the quadriceps. Stimulator 402 is capable of generating an electrical stimulation signal which causes the quadriceps to contract when applied thereto.

System 400 further comprises a command output 404 for sending a command signal to stimulator 402, a feedback loop 406 for transmitting a feedback signal from strain gauge 75, and a comparator 408 for comparing the feedback and command signals and generating an error signal. Stimulator 402, command output 404, feedback loop 406, and comparator 408 having utility in the present invention are all conventional equipment which can be selected or designed by the skilled artisan to perform in the manner described hereafter.

Although control system 400 has been described with reference to ergometer 10, it is apparent that control system 400 may likewise be incorporated with ergometers 110 or 210 in substantially the same manner. It is also apparent that the control system 400 may operate in conjunction with any or all units 104, 106, 108 shown in FIG. 1. Stimulator 402 may also operate with ergometers 10, 110, or 210, absent closed-loop control system 400, to provide electrical stimulation to the quadriceps without closed-loop control. Control of the stimulator may be provided manually or in conjunction with any or all units 104, 106, 108.

The method of operation of the present invention is described below with reference to FIGS. 1, 7, and 8. Since ergometer 10 has an adjustable torque member 42, the method is initiated by adjusting torque member 42 to define a predetermined extension angle $\phi$ of knee flexion. Torque member 42 is adjusted by loosening nut 86 and rotating proximal arm 38 relative to distal arm 40 until arms 38, 40 are oriented to correspond with the predetermined extension angle $\phi$. Guide markers 59 can be provided on ends 54, 56 to facilitate the alignment of arms 38, 40 which corresponds to the preselected extension angle $\phi$. Thereafter, nut 86 is tightened sufficiently such that substantially no rotation of arms 38, 40 relative to post 60 occurs during operation of ergometer 10.

Once the extension angle $\phi$ is fixed, ergometer 10 is slid under the leg 12 so that posterior upper leg abutting member 25 is fitted to posterior upper leg 14*a* and posterior lower leg abutting member 31 is fitted to the posterior lower leg 15*a*. Bolster 94 is fitted behind the knee 19 against the popliteal surface 16. Ergometer 10 is tightly secured in this position by cinching upper leg strap 24 through guide loop 26 so that strap 24 sits tightly across the anterior upper leg 14*b* and is fastened by velcro fastener 28. This same procedure is repeated for strap 30 across the anterior lower leg 15*b*. With ergometer 10 securely positioned on the leg 12, exercise of the quadriceps or hamstring muscles may be initiated.

For quadriceps exercise, the leg 12 is positioned at a predetermined fixed extension angle $\phi$ and the quadriceps muscles are contracted in an effort to straighten the leg 12. Contraction of the quadriceps muscles causes the anterior lower leg 15*b* to exert an upward force against lower leg strap 30 where it engages the anterior lower leg 15*b*. This force is transmitted through posterior lower leg abutting member 31 to rigid crossbar 36. Crossbar 36 is prevented from moving because proximal arm 38 and distal arm 40 of crossbar 36 are tightly joined at torque member 42 and further because proximal arm 38 is connected to upper leg abutting member 25 which is secured to stationary posterior upper leg 14*a* by upper leg strap 24. Thus, the leg 12 and ergometer 10 remain essentially static relative to one another while the quadriceps muscles are being contracted, thereby isometrically exercising the quadriceps muscles.

For hamstring exercise, the leg 12 is again positioned at a predetermined fixed extension angle $\phi$. However, when the hamstring muscles are contracted, they cause the posterior lower leg 15*a* to exert a downward force against lower leg abutting member 31 where it engages the posterior lower leg 15*a*. The structure of ergometer 10 cooperates with leg 12 to prevent movement thereof while the hamstring muscles are being contracted, thereby isometrically exercising the hamstring muscles.

If torque member 42 is provided with strain gauges 75, the user has the ability to measure the degree of force applied to ergometer 10 through the leg 12 by the quadriceps or hamstring muscles. When a force is transmitted to distal arm 40 from lower leg restraint 22, a torsional force is applied to post 60 which is prevented from rotating by washer 72 firmly gripping proximal arm 38. Strain gauges 75 measure this force which is correlated to the force applied by the patient's leg 12 to lower leg restraint 22.

Strain gauges 75 can communicate this force as an electrical force signal across line 102 to alarm 104, which is any conventional audio or visual indicator capable of generating an advisory signal to the patient, such as a buzzer or a light. Alarm 104 is activated when the force measured at strain gauges 75 exceed a certain level. Typically alarm 104 is set to activate at a force level which corresponds to the maximum safe level of muscle exercise for the recuperating patient. When the patient receives an advisory signal, the patient preferably reduces the level of muscle exercise. Strain gauges 75 can also communicate the measured torsional force across line 102 to recorder 108 which stores the force data for analysis or to display 106 which enables a user to instantaneously view the force data.

In the embodiment of the invention employing electric muscle stimulator 402, which is in electrical communication with the desired leg muscle or muscle group, muscle contractions are induced by activation of stimulator 402. Manual activation is performed by manually setting the built-in controls of stimulator 402 to a desired fixed level of electric stimulation which corresponds to a desired level of muscle exercise. Muscle stimulator 402 is then manually switched to the on position and an electrical stimulation signal at the predetermined level is delivered to the desired muscle. Stimulator 402 can be deactivated at any time by manually switching it to the off position. Similarly, the level of the stimulation signal from stimulator 402 can be changed to a new fixed point at any time by manually changing the control setting of the stimulator 402.

Closed-loop control system 400 incorporated with ergometer 10 can be used to automatically activate and control stimulator 402. Control system 400 is initiated by inputting a series of control parameters into command output 404, such as the level of force which the operator desires the leg to exert against the ergometer and other physical data relating to the patient. Command output 404 processes these parameters to generate a command signal which instructs stimulator 402 to stimulate the desired muscle to a degree necessary to induce the desired level of force on ergometer 10.

The resulting muscle contraction is translated by ergometer 10 to a torsional force against it and the force is recorded by strain gauges 75. This force is transmitted as a feedback signal through feedback loop 406 to comparator 408, which compares the command and feedback signals. If there is a difference between them, comparator 408 generates an error signal. The error signal is consequently sent to stimulator 402, adjusting the output accordingly.

More specifically, when strain gauges 75 measure an excessive torsional force on torque member 42 relative to the predetermined desired level of force, a comparison of the feedback and reference signals indicates that the output from stimulator 402 is excessive. Comparator 408 accordingly generates an error signal dictating a lower level of output from stimulator 402. Conversely, when strain gauges 75 measure an insufficient force relative to the predetermined desired level of force, the output from stimulator 402 is insufficient and comparator 408 generates an error signal dictating a higher stimulator output. Thus, closed-loop control system 400 automatically regulates the output of stimulator 402.

Although the method of operation for the present invention has been described with respect to ergometer 10, the skilled artisan will recognize that substantially the same method of operation applies to ergometers 110 and 210.

While the particular isometric leg muscle ergometers as herein shown and disclosed in detail are fully capable of obtaining the objects and providing the advantages herein before stated, it is to be understood that they are merely illustrative of the presently preferred embodiments of the invention and that no limitations are intended to the details of construction or design herein shown other than as described in the appended claims.

I claim:

1. An ergometer engageable with the leg of a patient for exercising a leg muscle comprising:

an upper leg restraint positionable on the upper leg;

a lower leg restraint positionable on the lower leg;

a crossbar rigidly connecting said upper leg restraint and said lower leg restraint;

a bolster positionable at the popliteal surface and connected to said upper and lower leg restraints; and measuring means operatively positioned on said ergometer to measure a force applied to said ergometer across the leg of the patient by contraction of the leg muscle.

2. An ergometer as recited in claim 1 wherein said cross bar comprises:

a proximal arm extending from said upper leg restraint;

a distal arm extending from said lower leg restraint; and a torque member engaging said proximal and distal arms, said torque member maintaining said proximal and distal arms in a fixed relationship and said torque member further having said measuring means mounted thereon.

3. An ergometer as recited in claim 2 wherein said upper leg restraint includes an upper leg strap to secure said proximal arm to said upper leg and said lower leg restraint includes a lower leg strap to secure said distal arm to said lower leg.

4. An ergometer as recited in claim 3 wherein said upper leg restraint further includes an upper leg abutting member posteriorly positionable on the upper leg and said lower leg restraint includes a lower leg abutting member posteriorly positionable on the lower leg.

5. An ergometer as recited in claim 3 wherein said upper leg restraint further includes an upper leg abutting member anteriorly positionable on the upper leg and said lower leg restraint includes a lower leg abutting member anteriorly positionable on the lower leg.

6. An ergometer as recited in claim 5 wherein said bolster is integral with said torque member and engages said crossbar to connect with said upper and lower leg restraints.

7. An ergometer as recited in claim 5 further comprising at least one strap connecting said bolster to said upper and lower leg restraints.

8. An ergometer as recited in claim 2 wherein said torque member comprises means for selectively positioning said proximal and distal arms in said fixed relationship as a function of a predetermined fixed extension angle of the knee.

9. An ergometer engageable with the leg of a patient for indicating contraction of a leg muscle which comprises:

orienting means engageable with the upper leg and the lower leg to fixably orient the knee at a predetermined extension angle;

support means connectable with said orienting means to stationarily support the back of the knee at said predetermined extension angle; and measuring means operatively mounted on said orienting means to measure a force applied to said orienting means across the leg of the patient by contraction of the quadriceps.

10. An ergometer as recited in claim 9 further comprising means in electrical communication with said measuring means for emitting an advisory signal in response to a predetermined level of force measured by said measuring means.

11. An ergometer as recited in claim 9 further comprising:

stimulation means in electrical communication with the leg muscle for electrically stimulating contraction of the leg muscle; and control means in electrical communication with said stimulation means and said measuring means for controlling the degree of electrical stimulation applied to the leg muscle in response to the force measured by said measuring means.

12. An ergometer as recited in claim 11 wherein said control means comprises:

means for establishing a command signal from control parameters;

means for transmitting a feedback signal from said measuring means;

means for comparing the command signal and the feedback signal and generating an error signal in response to a difference between the command and feedback signals, the error signal adjusting the output of said stimulation means.

13. An ergometer engageable with the leg of a patient for exercising a leg muscle comprising:

an upper leg restraint secured to the upper leg;

a lower leg restraint secured to the lower leg;

a cross bar rigidly connecting said upper leg restraint and said lower leg restraint, said cross bar comprising a proximal arm extending from said upper leg restraint, a distal arm extending from said lower leg restraint and a torque member engaging said proximal and distal arms, said torque member maintaining said proximal and distal arms in a fixed relationship;

a bolster positionable at the popliteal surface to stationarily support the back of the knee at a predetermined extension angle; and means operatively positioned on said torque member to measure a force applied to said ergometer across the leg of the patient by contraction of the leg muscle.

14. A method for determining the exercise level of a leg muscle of a patient comprising:

providing an ergometer having an orienting means, a support means connected to said orienting means and a measuring means mounted on said orienting means;

positioning said orienting means to engage the upper leg and the lower leg thereby straddling the knee;

positioning said support means at the popliteal surface to maintain the knee at a fixed predetermined extension angle;

contracting the leg muscle to apply a force from the lower leg against said orienting means without substantially changing said extension angle; and determining the response of said measuring means to the force applied against said orienting means as a measurement of the exercise level of the leg muscle.

15. A method as recited in claim 14 wherein the leg muscle is contracted in response to an electrical stimulation.

16. A method as recited in claim 14 further comprising:

generating an advisory signal when the force applied from the lower leg against said orienting means exceeds a predetermined value; and adjusting leg muscle contraction in response to said advisory signal.

17. A method as recited in claim 16 further comprising:

establishing a command signal from control parameters to dictate a level of said electrical stimulation to the leg muscle;

generating a feedback signal in response to leg muscle contraction;

comparing said feedback signal and said command signal;

generating an error signaling in response to a difference between said feedback and command signals; and adjusting said level of said electrical stimulation to the leg muscle in response to said error signal.

18. A method as recited in claim 14 wherein the leg muscle is of the quadriceps muscle group.

19. A method as recited in claim 18 wherein said extension angle is predetermined to substantially avoid loading the anterior cruciate ligament.

20. A method as recited in claim 19 wherein said extension angle is predetermined to substantially avoid loading the posterior cruciate ligament.

21. A method as recited in claim 14 wherein the leg muscle is of the hamstring muscle group.

22. A method as recited in claim 21 wherein said extension angle is predetermined to substantially avoid loading the posterior cruciate ligament.

23. A method as recited in claim 22 wherein said extension angle is predetermined to substantially avoid loading the anterior cruciate ligament.

* * * * *